US010858846B2

(12) United States Patent
Loebel

(10) Patent No.: US 10,858,846 B2
(45) Date of Patent: Dec. 8, 2020

(54) SWELLABLE SEALING LIP

(71) Applicant: Akzenta Paneele + Profile GMBH, Kaisersesch (DE)

(72) Inventor: Arne Loebel, Düsseldorf (DE)

(73) Assignee: Akzenta Paneele + Profile GMBH, Kaisersesch (DE)

( * ) Notice: Subject to any disclaimer, the term of this patent is extended or adjusted under 35 U.S.C. 154(b) by 0 days.

(21) Appl. No.: 16/562,756

(22) Filed: Sep. 6, 2019

(65) Prior Publication Data

US 2020/0087926 A1 Mar. 19, 2020

(30) Foreign Application Priority Data

Sep. 18, 2018 (EP) ..... 18195174

(51) Int. Cl.
*E04F 15/10* (2006.01)
*E04B 1/61* (2006.01)
*E04F 15/02* (2006.01)

(52) U.S. Cl.
CPC ..... *E04F 15/10* (2013.01); *E04B 1/6125* (2013.01); *E04B 1/6179* (2013.01); *E04F 15/02038* (2013.01)

(58) Field of Classification Search
CPC ..... E04F 15/10; E04F 15/02038; E04F 2201/0146; E04F 2201/0153; E04F 2201/0552; E04F 15/02016; E04B 1/6179; E04B 1/6125
See application file for complete search history.

(56) References Cited

U.S. PATENT DOCUMENTS 6,358,580 B1 * 3/2002 Mang ..... C08L 21/00 428/304.4
7,930,862 B2 * 4/2011 Bergelin ..... E04C 2/24 52/316

FOREIGN PATENT DOCUMENTS

DE 102007049021 A1 4/2009
EP 3294969 A1 3/2018

* cited by examiner

*Primary Examiner* — Patrick J Maestri
(74) *Attorney, Agent, or Firm* — Harness, Dickey & Pierce, P.L.C.

(57) ABSTRACT

A panel comprises a swellable sealing lip. The panel comprises a panel top side and a panel bottom side and at least four panel edges arranged mutually facing each other in pairs, with complementary retaining profiles provided in pairs at the mutually facing panel edges, wherein the retaining profiles are configured such that at a retaining profile of one panel further panels with a complementary retaining profile can be mounted. In this case, at least one retaining profile comprises a swellable sealing lip at least partially along its longitudinal axis. Moreover, an arrangement of such panels and a method for producing such panels are proposed. In summary, the above-described panel has the advantage that panel joints can be protected against ingress and penetration of liquids in a particularly good and easy way without applying permanent, additional stresses to the connection of joined retaining profiles.

13 Claims, 6 Drawing Sheets

SWELLABLE SEALING LIP

CROSS-REFERENCE TO RELATED APPLICATIONS

This application claims the benefit and priority of European patent application number 1815174.0, filed on Sep. 16, 2018. The entire disclosure of the above application is incorporated herein by reference.

FIELD

The present disclosure relates to a panel comprising a swellable sealing lip as well as an arrangement of panels comprising a swellable sealing lip, a method for producing a panel comprising a swellable sealing lip and the use of a swellable material for sealing panels.

BACKGROUND

Panels with retaining profiles are known per se and can be used in particular as decorated wall or floor panels, wherein the term wall panel also means panels which are suitable as a ceiling or door lining. They usually consist of a carrier or core of a solid material, such as a wood material, plastic or composite material which is provided on at least one side with a decorative layer and a covering layer and optionally with further layers, such as a wearing layer disposed between the decorative and the covering layer. The decorative layer is usually a printed paper impregnated with a resin. The covering layer and the remaining layers are usually made of resin, too.

Such known panels in a manner known per se include retaining profiles at the panel edges. The retaining profiles hold the panels together in the laid state by means of a form-fit connection. To this end, different retaining profiles are known. Simple tongue-and-groove joints comprise a simple groove and a complementary tongue that act perpendicular to the panel plane. More complex retaining profiles are known in particular for panels for glueless laying. In this case, the complementary retaining profiles of two panels to be joined are designed so that the form-fit connection by means of hooks and undercuts also prevents the panels from being pulled apart. The panels can therefore be laid floating, i.e. they do not need to be glued to the floor, and they also do not have to be glued to each other. As a result, the laying of such panels is particularly simple and quick and the laid floor can also be adapted to a certain degree to unevenesses of the floor and also respond to temperature fluctuations due to the flexibility of the connections.

However, a problem with such laid panels is that the joints are prone to liquid ingress. Here, liquids can even flow through the joint beneath the panels, where they can no longer be reached and removed without first removing the panels. This can, for example, cause a damage to the floor beneath the panels. In addition, for example, mould dangerous to health can form between the bottom side of the panel and the underground. This can remain undetected and its removal can be very expensive.

Thus, there is a need to protect the joints of laid panels against ingress and in particular penetration of liquids. It is known that the joints can be glued during laying. However, this has the disadvantage that the laying of the panels is associated with a considerable increased expense. In addition, this limits the flexibility of the panel connections. It is also known to treat the laid panels with a sealing. However, this has the disadvantage that the sealing can only prevent to a limited extent the ingress of liquids into the joints and that the durability of the sealing is much shorter than the lifetime of the laid panels and therefore often has to be reapplied.

The moisture protection of such panels may therefore still offer room for improvement. Potential for improvement may result, in particular, in the durability of the moisture protection and in the simplicity of use of a moisture protection.

SUMMARY

It is therefore the object of the present disclosure to provide improved means for protection against the penetration of moisture or liquids through panel joints.

This object is described by panels and further by an arrangement of such panels and a method for producing such panels. Preferred embodiments of the disclosure are provided in the dependent claims, in the description or in the figures, wherein further features described or shown in the dependent claims or in the description or in the figures, individually or in any combination, may constitute a subject matter of the disclosure, inasfar the opposite is not clearly obvious from the context.

The disclosure proposes a panel comprising a swellable sealing lip.

The panel comprises a panel top side and a panel bottom side and at least four panel edges which are mutually facing each other in pairs and comprise complementary retaining profiles which are provided at the mutually facing panel edges in pairs, wherein the retaining profiles are configured so that at one retaining profile of a panel further panels with a complementary retaining profile can be mounted, wherein at least one retaining profile comprises a swellable sealing lip at least partially along its longitudinal axis.

It could be shown in a surprising manner that such panels can be easily laid without additional expense and at the same time have an improved protection against ingress and penetration of liquids at the joints.

The term "panel" in the sense of the disclosure means in particular wall, ceiling, door or floor panels. These can have a decoration applied to a carrier plate and replicating a decorative template. Decorative panels are used in a variety of ways, both in the field of interior design of rooms as well as decorative cladding of buildings, for example in exhibition stand construction. One of the most common fields of application of decorative panels is their use as a floor covering. The decorative panels often have a decoration that is intended to replicate a natural material.

In the sense of the disclosure, the term "swellable" is to be understood as the property of a material to swell or to increase its volume by absorption of gas or liquid. The increase in volume may be, for example, a doubling or a tenfold increase in volume.

The term "sealing lip" is to be understood as an elongated device which is able to hydraulically seal two surfaces abutting each other.

In the sense of the disclosure, the term "panel edge" is to be understood as the surface which connects the panel top side to the panel bottom side.

The term "retaining profile" is to be understood as the geometric configuration of the panel edge. In this case, the term also means multi-part retaining profiles.

The term "complementary retaining profile" is to be understood as a retaining profile whose geometric configuration substantially complements that of another retaining profile. That is, a retaining profile, which has recesses substantially where the other retaining profile has projections and vice versa. Thus, two complementary retaining profiles can be mounted to each other in a form-fitting manner. In this case, cavities can remain between the complementary retaining profiles. For example, one retaining profile may comprise a groove and a complementary retaining profile may comprise a projection, or one retaining profile may comprise a hook and a complementary retaining profile may comprise a corresponding undercut, or both retaining profiles may comprise hooks and undercuts.

A previously described panel thus serves in particular the protection against ingress and penetration of liquids at panel joints.

In detail, a panel according to the disclosure comprises a panel top side and a panel bottom side as well as at least four panel edges mutually facing each other in pairs. In this case, complementary retaining profiles are provided in pairs on the mutually facing panel edges, wherein the retaining profiles are designed so that further panels with complementary retaining profile can be mounted to one retaining profile of a panel. In other words, a plurality of such panels can be laid on a surface and connected to each other via the complementary retaining profiles.

The panels according to the disclosure are characterized in that at least one retaining profile comprises a swellable sealing lip along the longitudinal axis.

This advantageously ensures that the means for protection against ingress and penetration of liquids at panel joints needs not to be provided only during laying. The panels according to the disclosure can therefore be laid exactly in the same way as panels without a swellable sealing lip, but at the same time offer an improved protection against ingress and penetration of liquids at panel joints after laying. Furthermore, it is advantageously achieved that no permanent, additional stresses act on the connection of joined retaining profiles by means of the swellability of the sealing lip and an additional stress is produced only by the swelling of the sealing lip, if required. This ensures that the connections remain flexible but at the same time enable an improved protection against ingress and penetration of liquids at panel joints.

In one embodiment of the disclosure it can be provided that the swellable sealing lip consists essentially of a material which is swellable by absorbing aqueous liquids.

Thus, it can be achieved that the panels have in particular an improved protection against ingress and penetration of liquids, as they occur most frequently in everyday life. Aqueous liquids can be, for example, rainwater, waste water, drinks, cleaning water, washing water, sweat or urine.

In a further embodiment of the disclosure it can be provided that the swellable sealing lip consists essentially of a water-insoluble polymer.

Thus, it can be achieved in particular that the swellable sealing lip remains functional even after frequent contact with aqueous liquids.

In a further embodiment of the disclosure it can be provided that the swellable sealing lip comprises a water-absorbing material selected from the group consisting of superabsorbents, acrylonitrile copolymers, polyacrylamide copolymers, ethylene-maleic acid anhydride copolymers, polyvinyl alcohol copolymers or combinations thereof. Likewise, in one embodiment of the disclosure, it may be provided that the swellable sealing lip comprises a water-absorbing material selected from the group consisting of crosslinked carboxy methyl celluloses, compressed celluloses, modified celluloses, cellulose ethers, bran or combinations thereof.

Thus, it can be achieved that the swellable sealing lip swells particularly well and therefore can be particularly thin, can absorb water particularly good and can easily be processed and/or mounted.

In a further embodiment of the disclosure it can be provided that the swellable sealing lip consists essentially of a material which forms hydrogels with water.

Thus, it can be achieved that water, which comes into contact with the sealing lip, is particularly well absorbed by the sealing lip. Furthermore, it can be achieved in an advantageous manner that the swellable sealing lip does not drip after absorbing water and thus no water soaks through the sealing lip.

In a further embodiment of the disclosure it can be provided that the swellable sealing lip comprises a binder.

Thus, it can be achieved that even materials which are usually brittle or are present in powder form can be processed into a sealing lip. A binder is understood as a material which can hold particles of a material together. The binder may be, for example, an elastomer which is present as a powder or as a fiber.

In a further embodiment of the disclosure it can be provided that the swellable sealing lip extends along the entire length of the retaining profile.

Thus, it can advantageously be achieved that the panel joint is protected over the entire length of the panel edge against ingress and penetration of liquids. In particular, it can be achieved in this way that a sealing effect occurs even when the panel is shortened during assembly.

In a further embodiment of the disclosure it can be provided that at least one retaining profile of each of the pairwise complementary retaining profiles comprises a swellable sealing lip.

In other words, it can be provided that at least one retaining profile of each pair of mutually facing complementary retaining profiles comprises a swellable sealing lip. This means that at least half of the retaining profiles comprise a swellable sealing lip. For a panel with four panel edges this means that it is provided that at least two non-facing retaining profiles comprise a swellable sealing lip.

As a result, it can advantageously be achieved that after laying a plurality of such panels on a surface all the panel joints comprise at least one swellable sealing lip. In this way it can be achieved that all panel joints and in particular also the points where two joints or three panels meet, are protected against ingress and penetration of liquids.

In a further embodiment of the disclosure it can be provided that all retaining profiles comprise a swellable sealing lip.

As a result, it can advantageously be achieved that after laying a plurality of such panels on a surface all the panel joints comprise two swellable sealing lips. Thus, it can be achieved that all panel joints and in particular also the points where two joints or three panels meet, are particularly well protected against ingress and penetration of liquids.

In a further embodiment of the disclosure it can be provided that the swellable sealing lip is mounted to the retaining profile in a firmly bonded, force-fitting or form-fitting way.

Thus, it can be achieved that the sealing lip does not unintentionally separate from the panel before laying. For example, it can be achieved that the sealing lip does not unintentionally detach from the panel during transport, storage or cutting of the panels.

By means of a firmly bonded connection it can in particular be achieved that the swellable sealing lip can be mounted at any position at the retaining profile. As a result, advantageously the assembly of a swellable sealing lip on filigree points of the retaining profile is possible. For a firmly bonded connection an adhesive may be provided. It can thereby be achieved that even a powdery sealing lip can be mounted to the retaining profile.

By a means of a force fitting and/or form-fitting connection it can be achieved that a sealing lip with a particularly large cross-section can be mounted to the retaining profile. As a result, a particularly large absolute change in volume can be achieved during a swelling of the sealing lip. For example, to this end a groove can be provided, into which a sealing lip can be pressed.

In one embodiment of the disclosure it may further be provided that the swellable sealing lip terminates substantially flush with the retaining profile.

As a result, it can be achieved that no additional stresses act on the connection of joined retaining profiles.

In one embodiment of the disclosure it can be provided that the swellable sealing lip is arranged in the retaining profile of the panel edge such that the swellable sealing lip after assembly of another panel with a complementary retaining profile comprises a clearance fit or transition fit with respect to the complementary retaining profile of the other panel.

As a result, it can also be achieved that no additional stresses act on the connection of joined retaining profiles.

In one embodiment of the disclosure it can be provided that the swellable sealing lip is arranged in such a manner in the retaining profile of the panel edge, that the swellable sealing lip after assembly of another panel with a complementary retaining profile, after swelling rests at the complementary retaining profile of the other panel in a hydraulically sealing form.

Thus, it can be achieved that, if required, i.e. when a liquid comes into contact with the joint, the panel joint is sealed by the swelling of the sealing lip, while no additional stresses act previously on the connection of joined retaining profiles.

The disclosure further proposes an arrangement of at least two panels with a swellable sealing lip.

In detail, an arrangement of at least two panels according to the disclosure is provided. In this case, the panels have complementary retaining profiles on mutually facing panel edges and are mounted to one another by means of the complementary retaining profiles.

The arrangement is characterized in that at least one of the mutually facing complementary retaining profiles comprises a swellable sealing lip along the longitudinal axis, and the swellable sealing lip comprises a clearance or transition fit with respect to the complementary retaining profile of the other panel edge, wherein the swellable sealing lip after absorption of an aqueous liquid rests against the complementary retaining profile of the other panel edge in a hydraulically sealing form.

By means of this arrangement it can be achieved in particular that each panel joint comprises a swellable sealing lip and it can be achieved that, if required, i.e. when a liquid comes into contact with the joint, the panel joint is sealed by the swelling of the sealing lip, while no additional stresses act previously on the connection of joined retaining profiles.

With the disclosure, moreover, a method for producing a panel comprising a swellable sealing lip is proposed.

In detail, it is provided that the method comprises the steps of:

providing a carrier, forming a retaining profile at at least one edge of the carrier, and mounting a swellable sealing lip to the retaining profile.

In this way it can advantageously be achieved that in the formation of the retaining profile a location for mounting the swellable sealing lip can already be provided. In addition, this also allows to adapt the swellable sealing lip to the retaining profile. The swellable sealing lip can be applied before or after the application of a decorative layer and a covering layer and optionally further layers, for example a wearing layer arranged between the decorative layer and the covering layer. The carrier can be made of a material typical for panels.

Within the scope of the disclosure it is further envisaged to use a swellable material for sealing panels.

In detail, it is envisaged that a swellable material will be used for sealing previously described panels.

By use of a swellable material it can be advantageously achieved that the panel joints are sealed by the swelling of the material only if required, i.e. when a liquid comes into contact with the joint, while no additional stresses act previously on the connection of joined retaining profiles.

DRAWINGS

The disclosure is explained below in more detail with reference to the figures. The figures show possible embodiments of the disclosure. In principle, however, combinations or modifications of the embodiments are possible within the scope of the disclosure. For example, the swellable sealing lip may have a different cross section and/or can be mounted to a different location to the retaining profile. In principle, the assembly of a swellable sealing lip to differently designed retaining profiles is possible, which are not shown below.

FIG. 1 shows schematically portions of two mutually facing complementary retaining profiles of a panel according to the disclosure;

FIGS. 2A and 2B schematically show a cross-section of joined complementary retaining profiles of two panels according to the disclosure from FIG. 1;

Figure 3A:
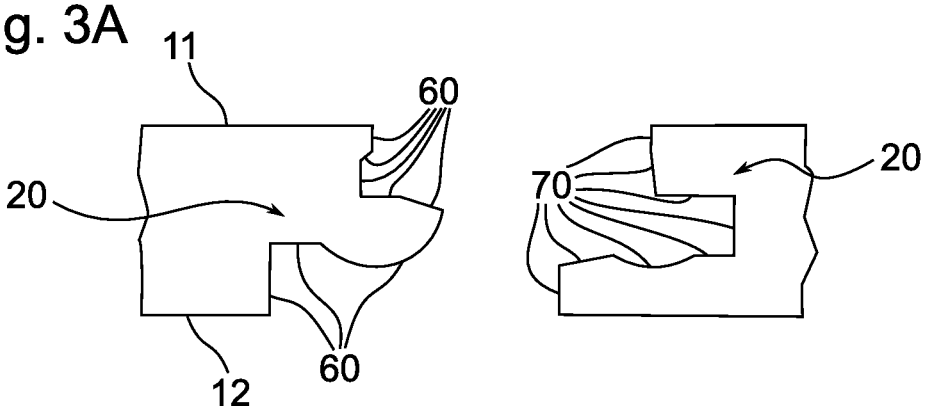
FIGS. 3A, 3B and 3C show schematically a cross-section of various complementary retaining profiles suitable for mounting a sealing lip.
Figure 3B:
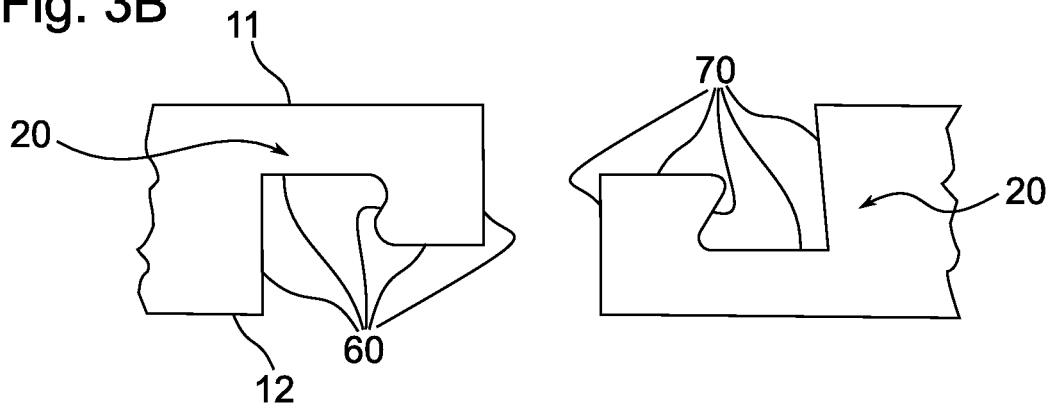
Figure 3C:
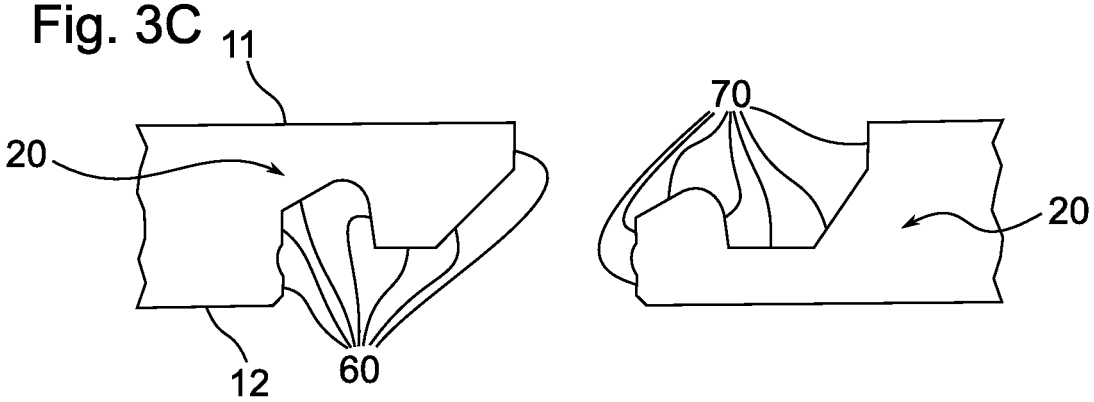

FIGS. 6A, 6B, 6C, 6D, 6E, 6F, 6G and 6H show schematically a cross-section of joined complementary retaining profiles of two respective panels according to the disclosure comprising the retaining profile of FIG. 3C; and FIGS. 7A, 7B, 7C, 7D, 7E and 7F show schematically a cross-section of joined complementary retaining profiles of two respective panels according to the disclosure comprising a multi-part retaining profile.

DETAILED DESCRIPTION

Figure 1:
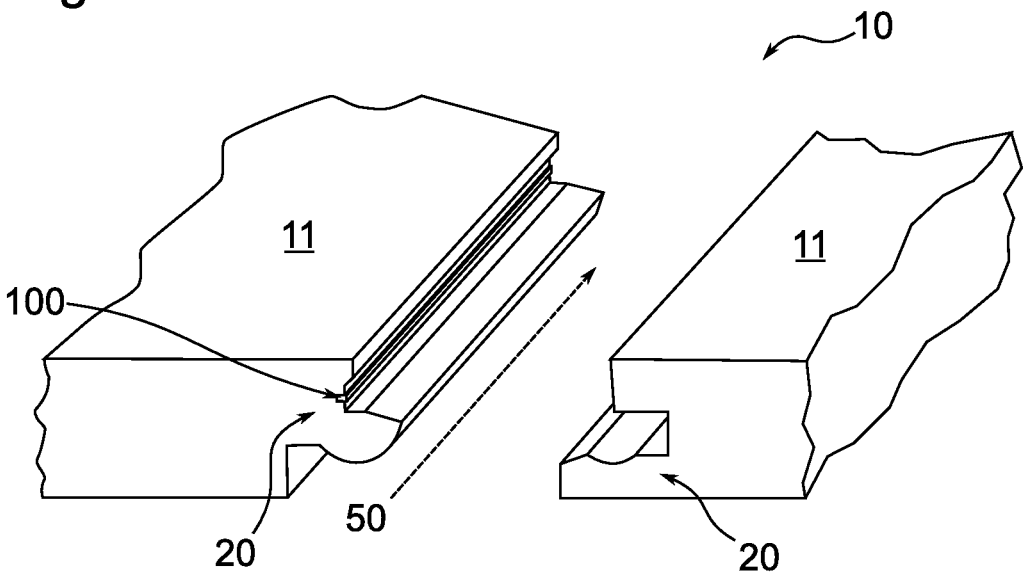

FIG. 1 shows schematically portions of two mutually facing complementary retaining profiles 20 of a panel 10 according to the disclosure with a panel top side 11. One of the retaining profiles 20 comprises a swellable sealing lip which extends at least partially along a longitudinal axis 50 of the retaining profile 20.

Figure 2A:
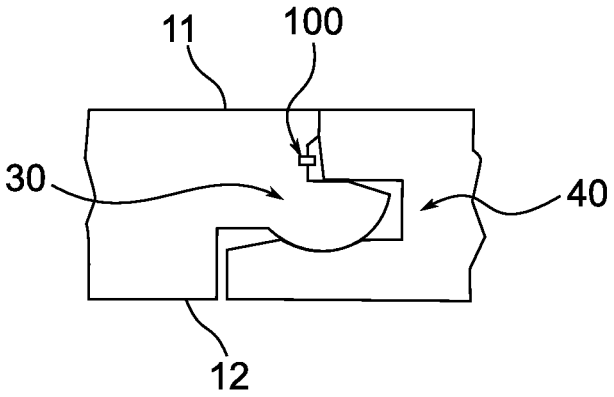
Figure 2B:
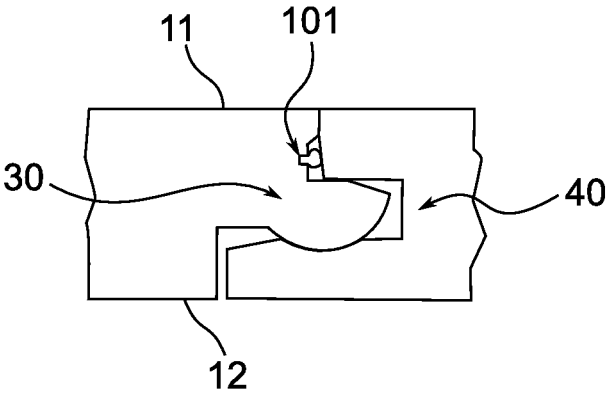

FIGS. 2A and 2B schematically show a cross-section of joined complementary retaining profiles of two panels according to the disclosure from FIG. 1 with a panel top side 11 and a panel bottom side 12. A retaining profile 30 comprises a swellable sealing lip 100 along the longitudinal axis. A complementary retaining profile 40 is mounted to the retaining profile 30. The swellable sealing lip 100 is arranged in the retaining profile 30 of the panel edge in such a way that it forms a clearance fit with the complementary retaining profile 40 in FIG. 2A. In FIG. 2B, the swellable sealing lip of FIG. 2A is shown in the swollen state 101. In this case, the swollen swellable sealing lip 101 abuts the complementary retaining profile 40 in a hydraulically sealing manner and prevents the penetration of liquids through the joint between the retaining profile 30 and the mounted complementary retaining profile 40.

FIGS. 3A, 3B and 3C show schematically a cross-section of various complementary retaining profiles, which are suitable for mounting a swellable sealing lip. FIG. 3A schematically shows a side view of complementary retaining profiles comprising a hook with a convex curvature on one side and a recess with a concave curvature on the other side. The retaining profile has a plurality of profile surfaces 60 and the complementary retaining profile has corresponding complementary profile surfaces 70, which are suitable for mounting a swellable sealing lip. FIG. 3B schematically shows a side view of complementary retaining profiles, each comprising a hook element, wherein the profile surfaces 60 and the complementary profile surfaces 70 are suitable for mounting a swellable sealing lip. FIG. 3C schematically shows a side view of complementary retaining profiles, each comprising a hook element with a recess and a latching element, wherein the profile surfaces 60 and the complementary profile surfaces 70 are suitable for mounting a swellable sealing lip 100.

FIGS. 4A, 4B, 4C, 4D, 4E and 4F schematically show a cross-section of joined complementary retaining profiles of two exemplary panels according to the disclosure with the retaining profile of FIG. 3A.

Figure 4A:
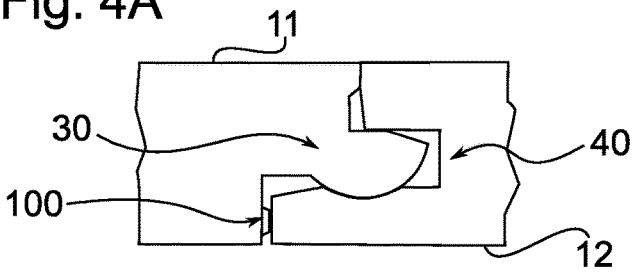
FIGS. 4A, 4B, 4C, 4D, 4E and 4F show schematically a cross section of joined complementary retaining profiles of two respective panels according to the disclosure comprising the retaining profile of FIG. 3A.
Figure 4B:
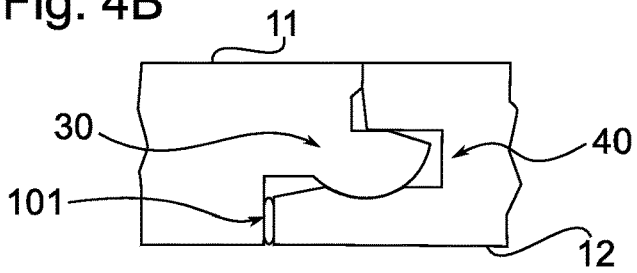

FIG. 4A shows two panels according to the disclosure, wherein a flat swellable sealing lip 100 is applied to a lower end face of the retaining profile 30. In this case, the swellable sealing lip 100 is arranged so that it forms a transition fit with the complementary retaining profile 40. In FIG. 4B, the swellable sealing lip of FIG. 4A is shown in the swollen state 101. In this case, the swollen swellable sealing lip 101 abuts the complementary retaining profile 40 in a hydraulically sealing manner.

Figure 4C:
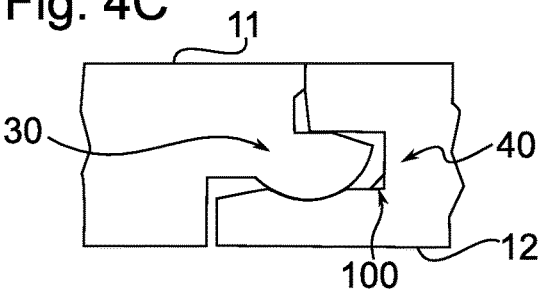
Figure 4D:
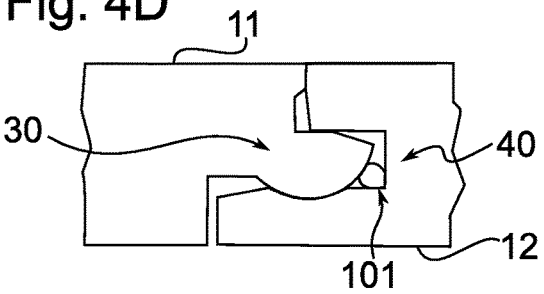

In FIG. 4C, a substantially triangular swellable sealing lip 100 is applied between two profile surfaces of the complementary retaining profile 40. In this case, the swellable sealing lip 100 is arranged so that it forms a clearance fit with the retaining profile 30. In FIG. 4D, the swellable sealing lip of FIG. 4C is shown in the swollen state 101. In this case, the swollen swellable sealing lip 101 abuts the retaining profile 30 in a hydraulically sealing manner.

Figure 4E:
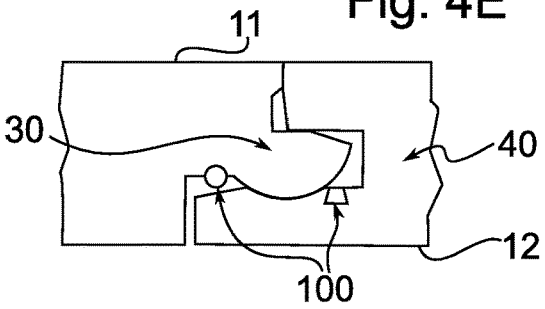
Figure 4F:
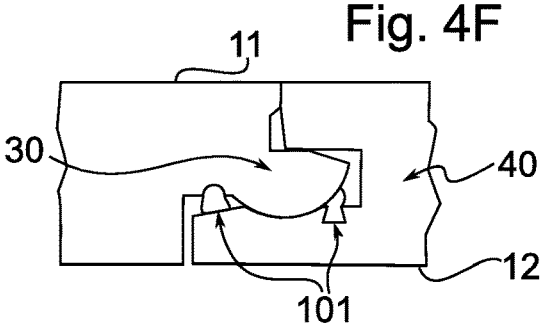

In FIG. 4E, a substantially circular swellable sealing lip 100 is embedded in a lower profile surface of the hook of the retaining profile 30. In addition, a substantially rectangular swellable sealing lip 100 is embedded in a lower profile surface of the recess of the complementary retaining profile 40. In this case, the swellable sealing lips 100 are arranged such that they form a clearance fit with the complementary retaining profile 40 and with the retaining profile 30, respectively. In FIG. 4F, the swellable sealing lips of FIG. 4E are shown in the swollen state 101. In this case, the swollen swellable sealing lips 101 abut the complementary retaining profile 40 and the retaining profile 30, respectively, in a hydraulically sealing form.

FIGS. 5A, 5B, 5C, 5D, 5E, 5F, 5G and 5H show schematically a cross-section of joined complementary retaining profiles of two respective panels according to the disclosure comprising the retaining profile of FIG. 3B.

Figure 5A:
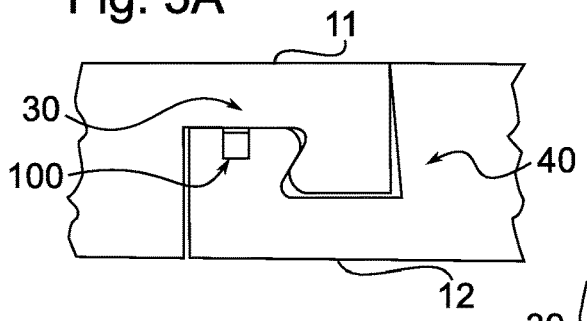
FIGS. 5A, 5B, 5C, 5D, 5E, 5F, 5G and 5H show schematically a cross-section of joined complementary retaining profiles of two respective panels according to the disclosure comprising the retaining profile of FIG. 3B.
Figure 5B:
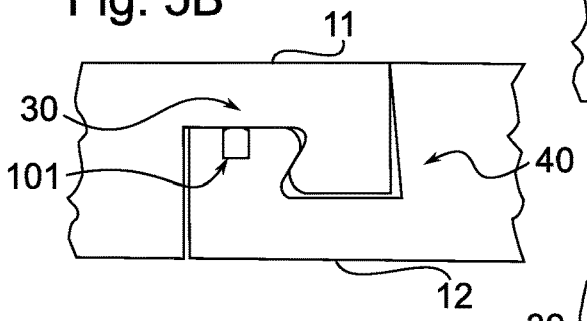

FIG. 5A shows two panels according to the disclosure, wherein a substantially rectangular swellable sealing lip 100 is embedded in an upwardly facing surface of a hook element of the complementary retaining profile 40. In this case, the swellable sealing lip 100 is arranged so that it forms a transition fit with the retaining profile 30. In FIG. 5B the swellable sealing lip of FIG. 5A is shown in the swollen state 101. In this case, the swollen swellable sealing lip 101 abuts the retaining profile 30 in a hydraulically sealing manner.

Figure 5C:
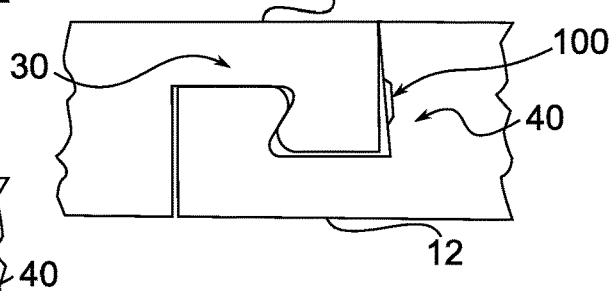
Figure 5D:
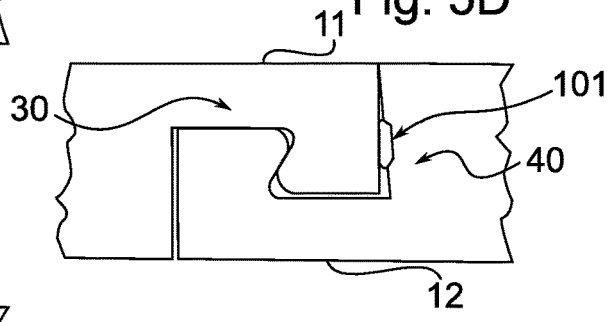

In FIG. 5C, a flat swellable sealing lip 100 is embedded in an inner end face of a hook element of the complementary retaining profile 40. In this case, the swellable sealing lip 100 is arranged so that it forms a clearance fit with the retaining profile 30. In FIG. 5D, the swellable sealing lip of FIG. 5C is shown in the swollen state 101. In this case, the swollen swellable sealing lip 101 abuts the retaining profile 30 in a hydraulically sealing manner.

Figure 5E:
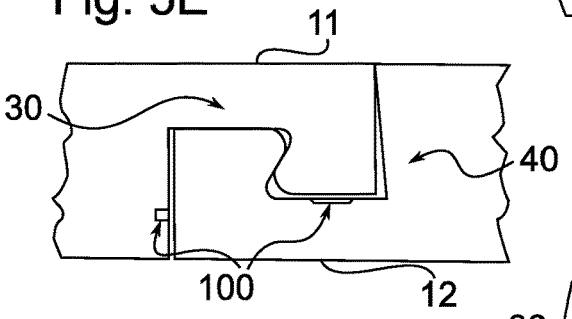
Figure 5F:
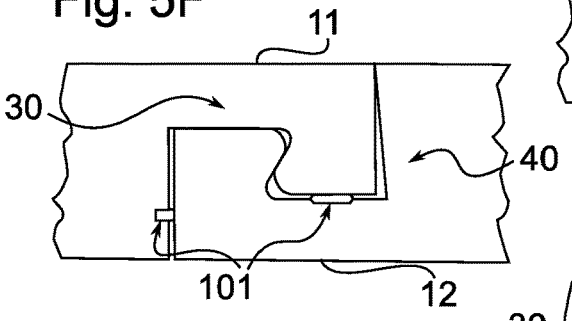

In FIG. 5E, a substantially rectangular swellable sealing lip 100 is embedded in an inner end face of a hook element of the retaining profile 30. In addition, a flat swellable sealing lip 100 is embedded in an upwardly facing surface of the hook element of the complementary retaining profile 40. In this case, the swellable sealing lips 100 are arranged such that they form a transition fit with the complementary retaining profile 40 and with the retaining profile 30, respectively. In FIG. 5F, the swellable sealing lips of FIG. 5E are shown in the swollen state 101. In this case, the swollen swellable sealing lips 101 abut the complementary retaining profile 40 and the retaining profile 30, respectively, in a hydraulically sealing form.

Figure 5G:
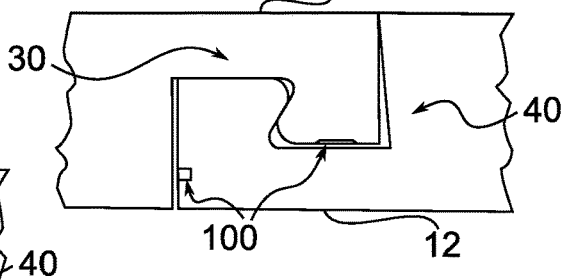
Figure 5H:
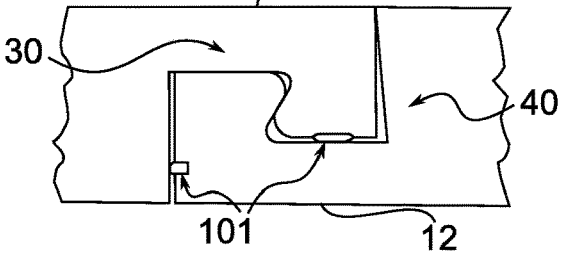

In FIG. 5G, a substantially rectangular swellable sealing lip 100 is embedded in an outer end face of a hook element of the complementary retaining profile 40. In addition, a flat swellable sealing lip 100 is embedded in a downwardly facing surface of the hook element of the retaining profile 30. In this case, the swellable sealing lips 100 are arranged such that they form a transition fit with the retaining profile 30 and with the complementary retaining profile 40, respectively. In FIG. 5H, the swellable sealing lips of FIG. 5G are shown in the swollen state 101. In this case, the swollen swellable sealing lips 101 abut the retaining profile 30 and the complementary retaining profile 40, respectively, in a hydraulically sealing form.

FIGS. 6A, 6B, 6C, 6D, 6E, 6F, 6G and 6H show schematically a cross-section of joined complementary retaining profiles of two respective panels according to the disclosure comprising the retaining profile of FIG. 3C.

Figure 6A:
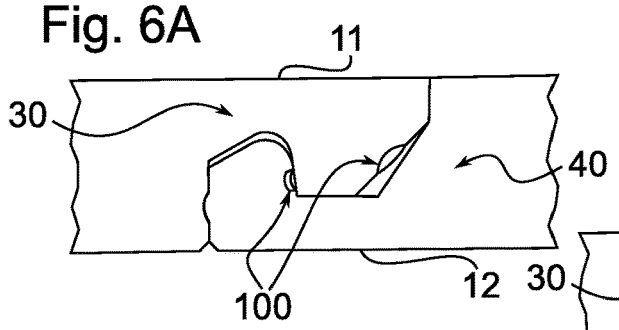

FIG. 6A shows two panels according to the disclosure, wherein a flat swellable sealing lip 100 is embedded in a surface of a hook element of the complementary retaining profile 40. In addition, a flat swellable sealing lip 100 is partially embedded in a downwardly facing surface of the hooking element of the retaining profile 30. In this case, the swellable sealing lips 100 are arranged such that they form a transition fit with the retaining profile 30 and a clearance fit with the complementary retaining profile 40, respectively. In FIG. 6B, the swellable sealing lips of FIG. 6A are shown in the swollen state 101. In this case, the swollen swellable sealing lips 101 abut the retaining profile 30 and the complementary retaining profile 40, respectively, in a hydraulically sealing form.

Figure 6C:
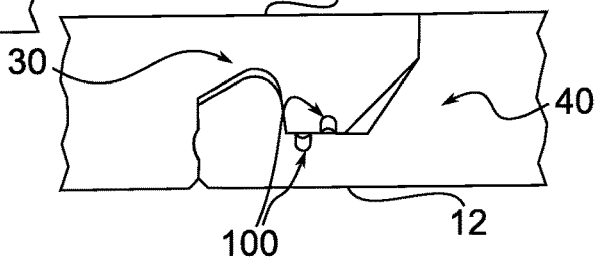
Figure 6B:
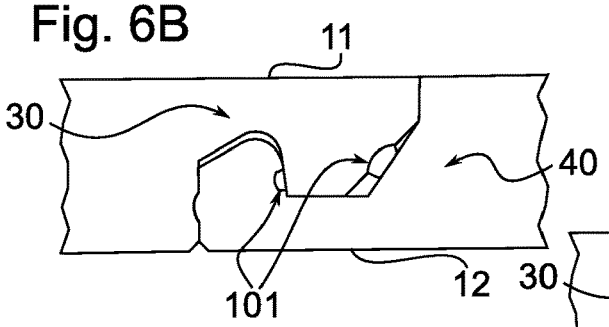
Figure 6D:
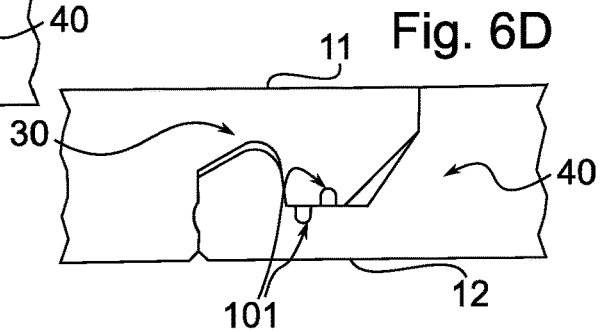

In FIG. 6C, a swellable sealing lip 100 is embedded in a surface of a hook element of the complementary retaining profile 40. In addition, a swellable sealing lip 100 is embedded in an opposite surface of the hook element of the retaining profile 30. In this case, the swellable sealing lips 100 are arranged such that they form a clearance fit with the retaining profile 30 and with the complementary retaining profile 40, respectively. In FIG. 6D, the swellable sealing lips of FIG. 6C are shown in the swollen state 101. In this case, the swollen swellable sealing lips 101 abut the retaining profile 30 and the complementary retaining profile 40, respectively, in a hydraulically sealing form.

Figure 6E:
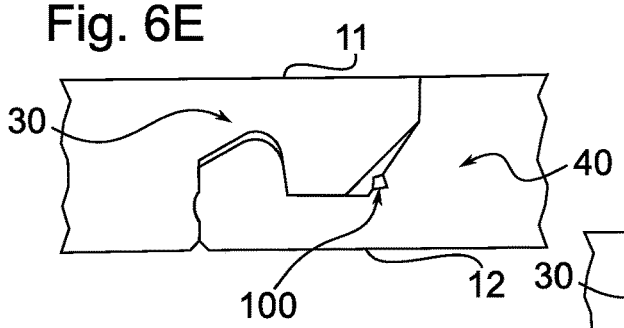

In FIG. 6E, a substantially quadrangular swellable sealing lip 100 is partially embedded in an inner end face of a hook element of the complementary retaining profile 40. In this case, the swellable sealing lip 100 is arranged so that it forms a clearance fit with the retaining profile 30. FIG. 6F shows the swellable sealing lip of FIG. 6E in the swollen state 101. In this case, the swollen swellable sealing lip 101 abuts the retaining profile 30 in a hydraulically sealing manner.

Figure 6G:
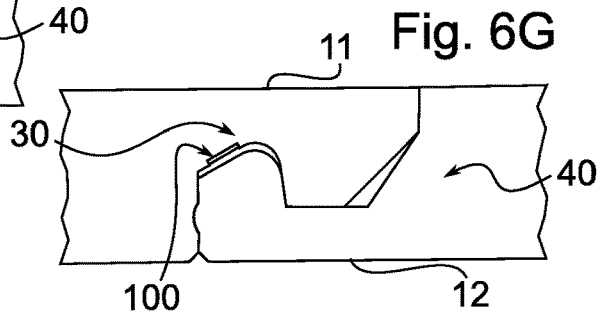
Figure 6F:
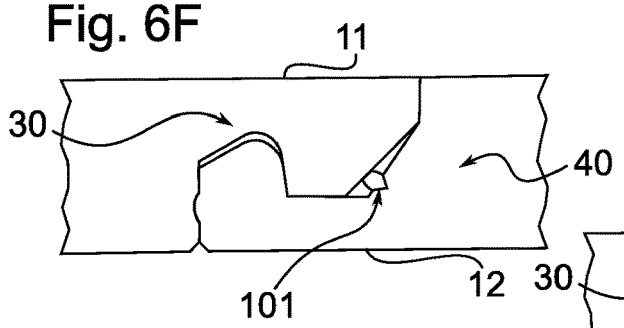
Figure 6H:
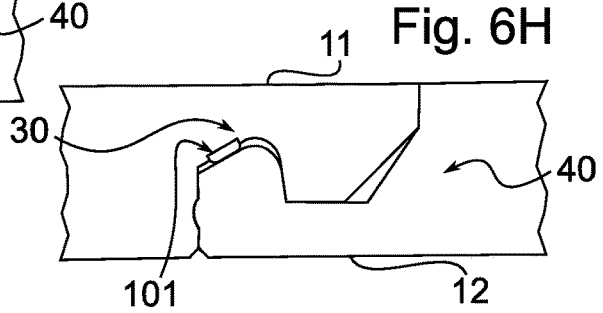

In FIG. 6G, a substantially quadrangular swellable sealing lip 100 is completely embedded in an inner surface of a hook element of the retaining profile 30. In this case, the swellable sealing lip 100 is arranged so that it forms a clearance fit with the complementary retaining profile 40. In FIG. 6H, the swellable sealing lip of FIG. 6G is shown in the swollen state 101. In this case, the swollen swellable sealing lip 101 abuts the complementary retaining profile 40 in a hydraulically sealing manner.

FIGS. 7A, 7B, 7C, 7D, 7E and 7F show schematically a cross section of joined complementary retaining profiles of two respective panels according to the disclosure with a multi-part retaining profile. In this case, the retaining profile additionally comprises a separate vertical locking element 80, which is embedded in a recess of the retaining profile.

Figure 7A:
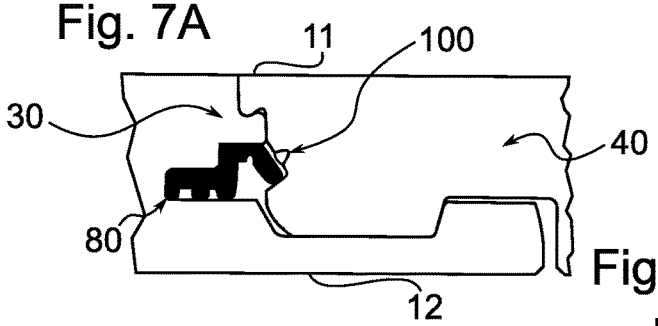
Figure 7B:
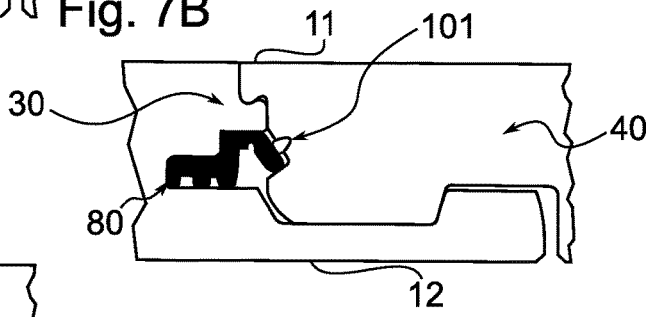

In FIG. 7A, a swellable sealing lip 100 is partially embedded in an end face of a hook element of the complementary retaining profile 40. In this case, the swellable sealing lip 100 is arranged so that it forms a clearance fit with the retaining profile 30. In FIG. 7B, the swellable sealing lip of FIG. 7A is shown in the swollen state 101. In this case, the swollen swellable sealing lip 101 abuts the retaining profile 30 in a hydraulically sealing manner.

Figure 7C:
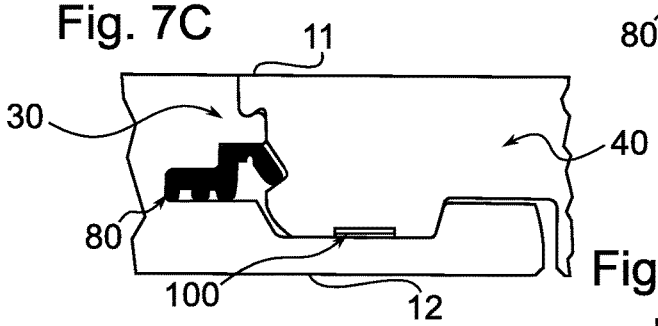
Figure 7D:
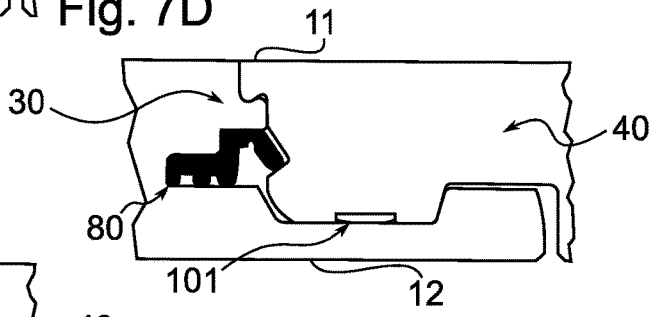

In FIG. 7C, a flat swellable sealing lip 100 is completely embedded in a surface of a hook element of the complementary retaining profile 40. In this case, the swellable sealing lip 100 is arranged so that it forms a clearance fit with the retaining profile 30. In FIG. 7D, the swellable sealing lip of FIG. 7C is shown in the swollen state 101. In this case, the swollen swellable sealing lip 101 abuts the retaining profile 30 in a hydraulically sealing manner.

Figure 7E:
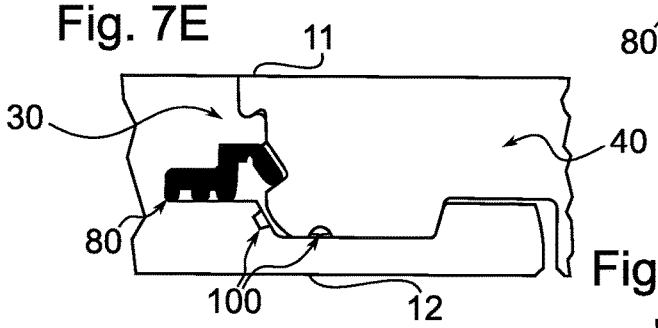
Figure 7F:
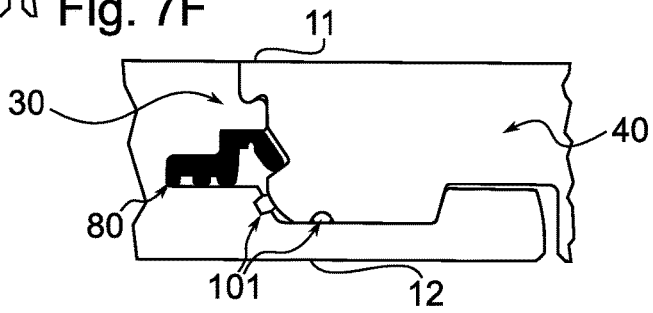

In FIG. 7E, a swellable sealing lip 100 is embedded in a surface of a hook element of the complementary retaining profile 40. In addition, a swellable sealing lip 100 is embedded in a surface of the hook member of the retaining profile 30. In this case, the swellable sealing lips 100 are arranged such that they form a clearance fit with the retaining profile 30 and with the complementary retaining profile 40, respectively. In FIG. 7F, the swellable sealing lips of FIG. 7E are shown in the swollen state 101. In this case, the swollen swellable sealing lips 101 abut the retaining profile 30 and the complementary retaining profile 40, respectively, in a hydraulically sealing form.

What is claimed is:

1. A panel comprising a carrier layer including top side and a bottom side and at least four edges arranged facing each other in pairs, with complementary retaining profiles arranged in pairs on the mutual facing edges, wherein the retaining profiles are configured such that at a retaining profile of one panel further panels with complementary retaining profile can be mounted, wherein at least one retaining profile comprises a swellable sealing lip at least partially along its longitudinal axis, wherein the swellable sealing lip is spaced apart from the top side and consists essentially of a substantially water-insoluble polymer which is swellable by absorbing aqueous liquids.

2. The panel according to claim 1, wherein the swellable sealing lip comprises a water-absorbing material selected from the group consisting of superabsorbents, acrylonitrile copolymers, polyacrylamide copolymers, ethylene-maleic acid anhydride copolymers, polyvinyl alcohol copolymers or combinations thereof.

3. The panel according to claim 1, wherein the swellable sealing lip comprises a water-absorbing material selected from the group consisting of crosslinked carboxy methyl celluloses, compressed celluloses, modified celluloses, cellulose ethers, bran or combinations thereof.

4. The panel according to claim 1, wherein the swellable sealing lip consists essentially of a material which forms hydrogels with water.

5. The panel according to claim 1, wherein the swellable sealing lip comprises a binder.

6. The panel according to claim 1, wherein the swellable sealing lip extends along the entire length of the retaining profile.

7. The panel according to claim 1, wherein at least one retaining profile of each of the pairwise complementary retaining profiles comprises a swellable sealing lip.

8. The panel according to claim 1, wherein all retaining profiles comprise a swellable sealing lip.

9. The panel according to claim 1, wherein the swellable sealing lip terminates substantially flush with the retaining profile.

10. The panel according to claim 1, wherein the swellable sealing lip is arranged in such a manner in the retaining profile of the edge, that the swellable sealing lip, after mounting another panel with a complementary retaining profile, forms a clearance fit or transition fit with the complementary retaining profile of the other panel.

11. The panel according to claim 1, wherein the swellable sealing lip is arranged in such a manner in the retaining profile of the edge, that the swellable sealing lip, after mounting another panel with a complementary retaining profile, after swelling abuts the complementary retaining profile of the other panel in a hydraulically sealing form.

12. An arrangement of at least two panels according to claim 1, wherein the panels comprise complementary retaining profiles at mutually facing edges and the two panels are mounted to each other by means of the complementary retaining profiles, wherein at least one of the mutually facing complementary retaining profiles comprises a swellable sealing lip along its longitudinal axis, and the swellable sealing lip forms a clearance fit or a transition fit with the complementary retaining profile of the other edge, wherein the swellable sealing lip after absorption of an aqueous liquid abuts the complementary retaining profile of other edge in a hydraulically sealing form.

13. A method for producing a panel according to claim 1, comprising the steps:

providing the carrier, forming the retaining profile at at least one edge of the carrier, mounting the swellable sealing lip to the retaining profile.

* * * * *